US007104931B2

(12) United States Patent
Saul

(10) Patent No.: US 7,104,931 B2
(45) Date of Patent: Sep. 12, 2006

(54) EXERCISE SYSTEM AND METHOD FOR SIMULATING A SWIMMING MOTION

(75) Inventor: Robert Marc Saul, Philadelphia, PA (US)

(73) Assignee: Philadelphia Nutrition & Phitness, Inc., Philadelphia, PA (US)

( * ) Notice: Subject to any disclaimer, the term of this patent is extended or adjusted under 35 U.S.C. 154(b) by 3 days.

(21) Appl. No.: 10/838,088

(22) Filed: May 3, 2004

(65) Prior Publication Data

US 2005/0245360 A1 Nov. 3, 2005

(51) Int. Cl.
*A63B 69/10* (2006.01)
*A63B 21/02* (2006.01)

(52) U.S. Cl. ..... 482/56; 434/254

(58) Field of Classification Search ..... 482/55, 482/56, 121–124, 126, 129, 130, 142–144, 482/111, 112, 148; 441/550; 434/254
See application file for complete search history.

(56) References Cited

U.S. PATENT DOCUMENTS

| | | | | | |
|---|---|---|---|---|---|
| 326,247 | A | * | 9/1885 | Root | 482/56 |
| 350,932 | A | * | 10/1886 | Keating | 482/56 |
| 1,433,142 | A | * | 10/1922 | Maurer | 482/56 |
| 2,109,775 | A | * | 3/1938 | Hudson | 482/56 |
| 2,434,542 | A | * | 1/1948 | Borroughs | 482/56 |
| 3,976,058 | A | | 8/1976 | Tidwell | |
| 4,422,634 | A | | 12/1983 | Hopkins | |
| 4,529,192 | A | | 7/1985 | Stites | |
| 4,537,396 | A | | 8/1985 | Hooper | |
| 4,674,740 | A | | 6/1987 | Iams et al. | |
| 4,844,450 | A | | 7/1989 | Rodgers, Jr. | |
| 4,948,119 | A | | 8/1990 | Robertson, Jr. | |
| 5,178,593 | A | | 1/1993 | Roberts | |
| 5,269,736 | A | | 12/1993 | Roberts | |
| 5,282,748 | A | | 2/1994 | Little | |
| 5,306,222 | A | * | 4/1994 | Wilkinson | 482/124 |
| 5,366,426 | A | | 11/1994 | Glavin | |
| 5,391,080 | A | | 2/1995 | Bernacki et al. | |
| 5,393,280 | A | * | 2/1995 | Haviv | 482/56 |
| 5,429,564 | A | | 7/1995 | Doane | |
| 5,518,472 | A | | 5/1996 | Chen | |
| 5,540,591 | A | | 7/1996 | Doane | |
| 5,593,374 | A | * | 1/1997 | Gvoich | 482/123 |
| 5,603,676 | A | | 2/1997 | Cymbalisty | |
| 5,628,632 | A | | 5/1997 | Doane | |
| 5,688,210 | A | | 11/1997 | Chou | |
| 5,707,320 | A | | 1/1998 | Yu | |

(Continued)

*Primary Examiner*—Jerome Donnelly
*Assistant Examiner*—Tam Nguyen
(74) *Attorney, Agent, or Firm*—Cozen O'Connor, P.C.

(57) ABSTRACT

A system and method for simulating a swimming stroke wherein the resistance is supplied by resilient members connected to the user's arms and legs. In one aspect the invention is an exercise system comprising: a bench for supporting a user; means for securing to the user's left arm; means for securing to the user's right arm; means for securing to the user's left leg; means for securing to the user's right leg; and each of the left arm securing means, the right arm securing means, the left leg securing means, and the right leg securing means connected to the bench by at least one resilient member. Preferably the resilient members are connected to a pair of specially adapted gloves and socks. In another aspect, the invention is a method of using the system to simulate a swimming stroke wherein the user's movement is resisted during the entire range of motion.

11 Claims, 3 Drawing Sheets

FIG.1A

U.S. PATENT DOCUMENTS 5,728,033 A 3/1998 Rogers
5,957,815 A 9/1999 Labrenz
6,142,912 A 11/2000 Profaci
6,149,552 A 11/2000 Chen
6,287,242 B1 * 9/2001 Fray ..... 482/121
6,348,026 B1 * 2/2002 Kuo ..... 482/126
6,533,708 B1 3/2003 Taggett
6,540,651 B1 * 4/2003 Aberton et al. ..... 482/124
6,764,432 B1 * 7/2004 Hippensteel ..... 482/56
2005/0113225 A1 * 5/2005 Dovner et al. ..... 482/121

* cited by examiner

EXERCISE SYSTEM AND METHOD FOR SIMULATING A SWIMMING MOTION

FIELD OF THE INVENTION

The present invention relates generally to systems and methods for exercising, and specifically to systems and methods for exercising that simulate a swimming motion.

BACKGROUND OF THE INVENTION

Swimming is recognized as one of the best exercises for muscle toning, weight loss, and cardiovascular conditioning. Despite this, swimming is not widely used as a means to exercise. This is because in order to swim one must have access to a pool or another body of water. While gyms and fitness clubs often have pools on the premises, many people either do not have time to regularly attend gym or do not have the financial resources required to belong to such facilities. Additionally, some people do not enjoy getting wet and/or spending the time necessary to fix themselves up after a swimming workout. Thus, a need exists for exercise equipment that can simulate the physical workout achieved during swimming without the associated drawbacks.

Exercise equipment currently exists that allows users to simulate a swimming motion. However, available swimming simulators suffer from a variety of drawbacks. Some swimming simulators are very expensive and mechanically complex. Other swimming simulators are bulky and large in size, making it difficult for a user to store/use the equipment in the comfort of their own home. Still other swimming simulators do not properly simulate the swimming motion and/or supply constant resistance to the user's motion throughout the entire range of a swimming stroke.

DISCLOSURE OF THE INVENTION

It is therefore an object of the present invention to provide an exercise system and method for simulating a swimming motion.

Another object of the present invention is to provide an exercise system for simulating a swimming motion that is easy to use.

Yet another object of the present invention is to provide an exercise system for simulating a swimming motion that is easy and/or cost effective to manufacture.

Still another object of the present invention is to provide an exercise system and method for simulating a swimming motion that can be used in the comfort of one's home.

A further object of the present invention is to provide an exercise system for simulating a swimming motion that is compact and/or can be easily stored.

A still further object is to provide an exercise system and method for simulating a swimming motion that provides constant resistance to a user performing a swimming stroke during the entire range of motion.

These and other objects are met by the present invention, which in one aspect is an exercise system for simulating a swimming motion comprising: a bench for supporting a user in a horizontal orientation; means for securing to the user's left arm; means for securing to the user's right arm; means for securing to the user's left leg; means for securing to the user's right leg; and wherein each of the left arm securing means, the right arm securing means, the left leg securing means, and the right leg securing means are connected to the bench by at least one resilient member.

The left arm securing means and the right arm securing means are preferably a pair of gloves. Each glove can be connected to the bench by two resilient members. In this embodiment, a first resilient member connects a wrist portion of the glove to the bench while a second resilient member connects a forearm portion of the glove to the bench. It is further preferred that the wrist portion and forearm portion of the gloves comprise hard rubber rings to which the resilient members are attached. The gloves can be fingerless to allow ventilation during use.

Similarly, the left leg securing means and the right leg securing means are preferably a pair of socks. Like the gloves, each sock is preferably connected to the bench by two resilient members. In this embodiment, a first resilient member connects an ankle portion of each sock to the bench while a second resilient member connects a shin portion of each sock to the bench. The ankle portion and shin portion of the socks preferably comprise hard rubber rings to which the resilient members are attached. The socks can be toeless to allow ventilation during use.

The resilient members can be constant resistance bands or variable resistance bands and are made out of elastic type materials, such as that sold under the name BUNGEE. The resilient members preferably connect to the bench and to the gloves and socks via tension screws. During use, the resilient members are elongated, thus, providing resistance to movement. When force is not exerted on the resilient members, the resilient members return to their original length.

During use, the user lies on a substantially planar portion of the bench which is atop a frame. The frame can be adjustable in height. The resilient members can connect to the sides of the planar portion at a position beneath a user that is lying on the bench. In order to afford ease of storage and transfer, the bench can further comprise a base having wheels. A form fitting material can be supplied as padding on top of the planar portion for comfort. A head support can be connected to the bench to relieve strain on the user's neck during use.

The length of the resilient members and the angle at which the resilient members connect to the bench is chosen so that when a user lies down on the bench and equips the gloves and socks and performs a swimming motion (i.e., a swimming stroke), the user's movement of his/her left leg, right leg, left arm, and right arm is resisted by the resilient members during the entire range of motion. As used herein a swimming motion, includes both movement of the user's arms and legs. Additionally, the system can be used to perform kicking exercises for a lower body workout without performing the associated arm movements.

In another aspect, the invention is a method of exercising comprising the steps of: a user lying on a bench; the user equipping a pair of gloves, each glove connected to the bench by at least one resilient member; the user equipping a pair of socks, each sock connected to the bench by at least one resilient member; and the user performing a swimming motion, the resilient members resisting the user's movement during an entire range motion.

DETAILED DESCRIPTION OF THE DRAWINGS

Figure 1A:
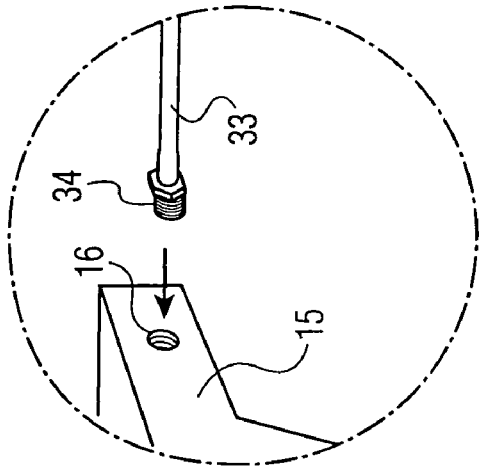
FIG. 1A is a close-up view showing the connection between one of the resilient band and the bench of the swimming simulator of FIG. 1.
Figure 1:
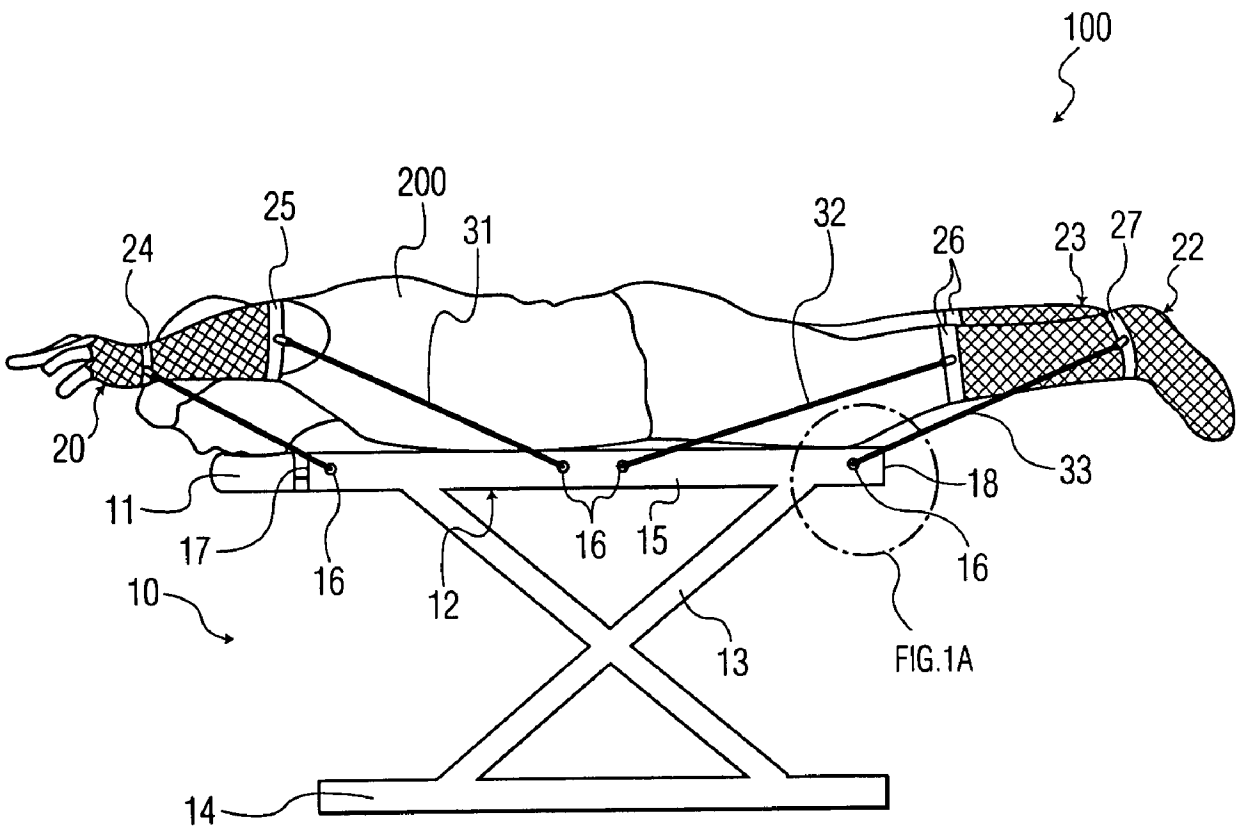
FIG. 1 is a side view of a person using a swimming simulator designed according to an embodiment of the present invention.

Referring to FIG. 1, swimming simulator 100 is illustrated according to an embodiment of the present invention. Swimming simulator 100 comprises bench 10, left glove 20, right glove 21 (FIG. 3), left sock 22, and right sock 23 (best shown in FIG. 2). Bench 10 comprises head rest 11 and planar portion 12 and is preferably designed to be capable of supporting up three hundred fifty pounds. Planar portion 12 is supported by X-frame 13, which is preferably adjustable in height and collapsible for ease of storage. X-frame 13 folds-up/collapses in a manner similar to that used with conventional ironing-boards. X-frame 13 is connected to base 14. A plurality of wheels (not illustrated) can be provided on base 14 so that swimming simulator 100 can be easily transported and/or stored. Head rest 11 can be pivotally connected to the rest of bench 10, e.g. by a spring-loaded hinge, and can be adjustable in height and easily removable. Head rest 11 and planar portion 12 are preferably padded (not illustrated) for comfort. The padding can be foam, sponge, or constructed of a form-fitting material, such as an open cell visco-elastic material. One suitable open cell visco-elastic material is that which is sold under the name Tempur-pedic.

Head rest 11 is preferably a U-shaped padded rest, similar to those used with massage tables so that the user can lie face down in comfort. Optionally, a pair of rigid leg sleeves (not illustrated) can be pivotally connected to rear end 18 via a spring hinge for guiding movement of the user's legs while performing a kicking motion.

Glove 20 is connected to bench 10 by two resilient bands 30–31. Specifically, resilient band 30 connects wrist portion 24 of glove 20 to bench 10 while resilient band 31 connects forearm portion 25 to bench 10. Similarly, sock 22 is connected to bench 10 by two resilient bands 32–33. Resilient band 31 connects shin portion 26 of sock 22 to bench 10 while resilient band 33 connects ankle portion 27 to bench 10. Resilient bands 30–33 connect to left side 15 of planar portion 12 of bench 10 underneath a person 200 using swimming simulator 100 to exercise. While not visible in FIG. 1, right sock 23 and right glove 21 are connected to the right side of planar portion 12 of bench 10 in an arrangement identical to, and symmetric with the connection of left glove 20 and left sock 22 to the left side 15 of bench 10.

Resilient bands 30–33 are stretchable elastic cords that can be of the constant resistance type or the variable resistance type. For example, resilient bands 30–33 can be commercially available BUNGEE elastic type cords. Suitable resilient bands 30–33 can be constructed using a high grade rubber core surrounded by a tight weave polypropylene sheathing. Multiple sets of resilient bands 30–33 can be provided with swimming simulator 100 having varying levels of resistance. As a user gets more in shape and stronger using swimming simulator 100, he/she can replace less resistive resilient bands with resilient bands having a higher resistance value. Each of the resilient bands 30–33 has two tension screws 34 (FIG. 1A) provided at its ends for facilitating connection to bench 10 at one end and connection to the appropriate glove 20–21 or sock 22–23 at the opposite end With reference to FIG. 1A, the connection of resilient band 33 to bench 10 will be described in detail. In order to avoid redundancy, the connection of resilient bands 30–32 will be omitted with the understanding that resilient bands 30–32 connect to bench 10 in an identical fashion. Resilient band 33 comprises male tension screw 34 provided at one of its ends. Male tension screw 34 comprises threads on its outer surface. Threaded hole 16 is provided in side 15 of planar portion 12 of bench 10. In connecting resilient band 33 to bench 10, male tension screw 34 is aligned with threaded hole 16 and turned in a clockwise rotation. During rotation, male tension screw 34 is pulled into and threadily engages hole 16. A total of 8 threaded holes 16 (4 on each side) are provided on the sides of planar portion 12 of bench 10 to facilitate connection of all of the resilient bands 30–33 for all of the gloves 20, 21 and socks 22,23. Other suitable connections can be implemented to connect the resilient bands, such as a snap-fit assembly, a ball-and-joint assembly, or a hook-eye assembly.

Figure 2:
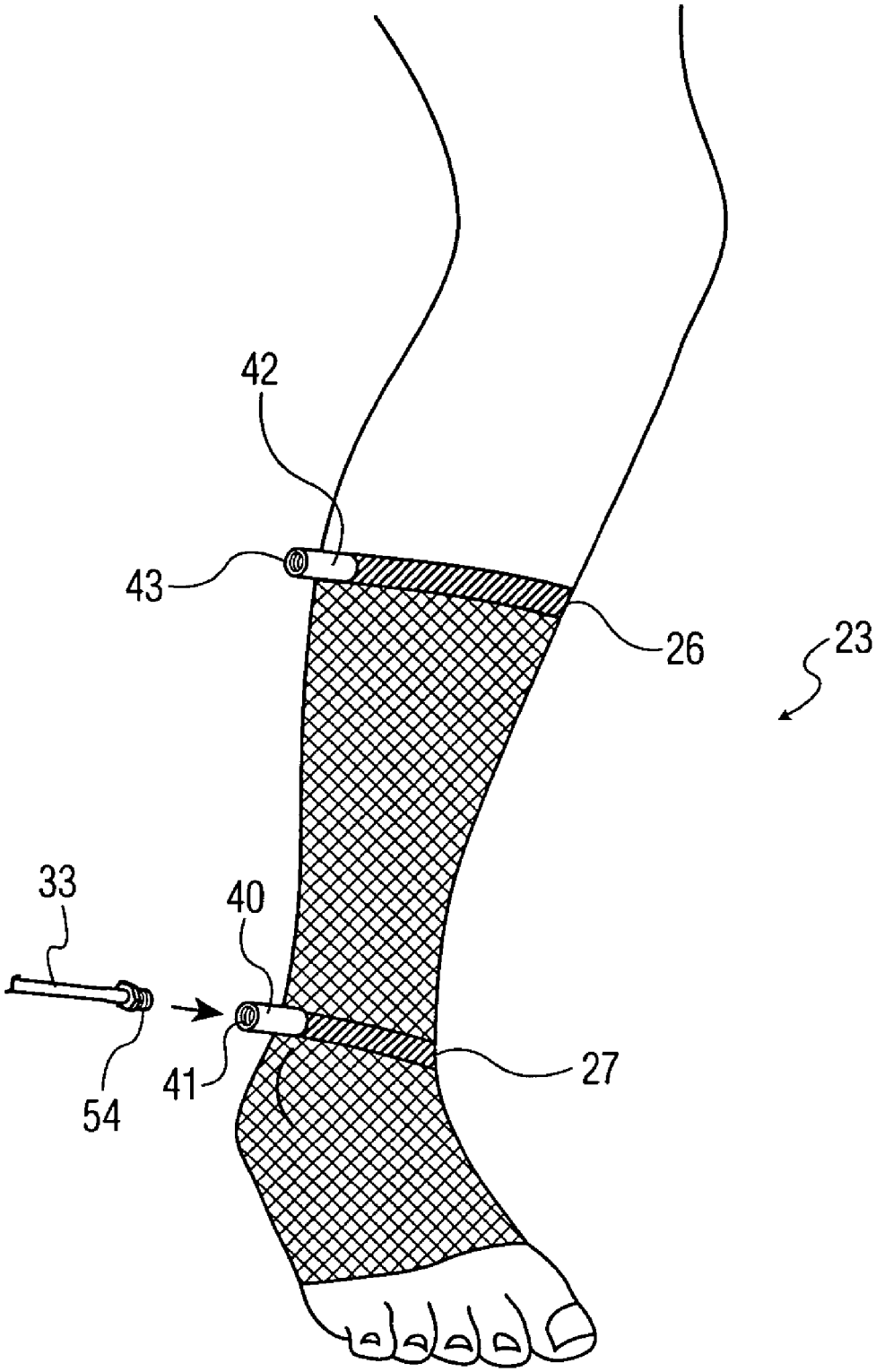
FIG. 2 is a perspective view of one of the socks of the swimming simulator of FIG. 1.

Referring now to FIG. 2, the connection of resilient band 33 to ankle portion 27 of right sock 23 will be discussed in detail. A second male tension screw 54, identical to male tension screw 34 (FIG. 1A), is provided at the opposite end of resilient band 33 for connection to female receptor 40. Female receptor 40 protrudes from ankle portion 27 of right sock 23 and comprises threaded cavity 41 for receiving the second threaded male tension screw 54 of resilient band 33 in a manner similar to that described above with respect to the connection of tension screw 34 to hole 16 of bench 10. Female receptor 40 can be constructed of a metal.

Regarding connection of resilient member 32 to shin portion 26, a male tension screw is provided at the end of resilient member 32 for threadily engaging threaded cavity 43 of female receptor 42, which protrudes from shin portion 26 of right sock 23. Left sock 22 is connected to resilient members 32, 33 in an identical manner as discussed above.

Socks 22, 23 are toeless and comprise ankle portion 27 and shin portion 26. Ankle portion 27 and shin portion 26 comprise hard rubber rings that are integral to the rest of the sock. Preferably, metal wire loops (not visible) extend through the centers of the hard rubber rings of ankle portion 27 and shin portion 26. Female receptors 40 and 42 are connected to the metal wire loop of ankle portion 27 and shin portion 26 respectively.

Figure 3:
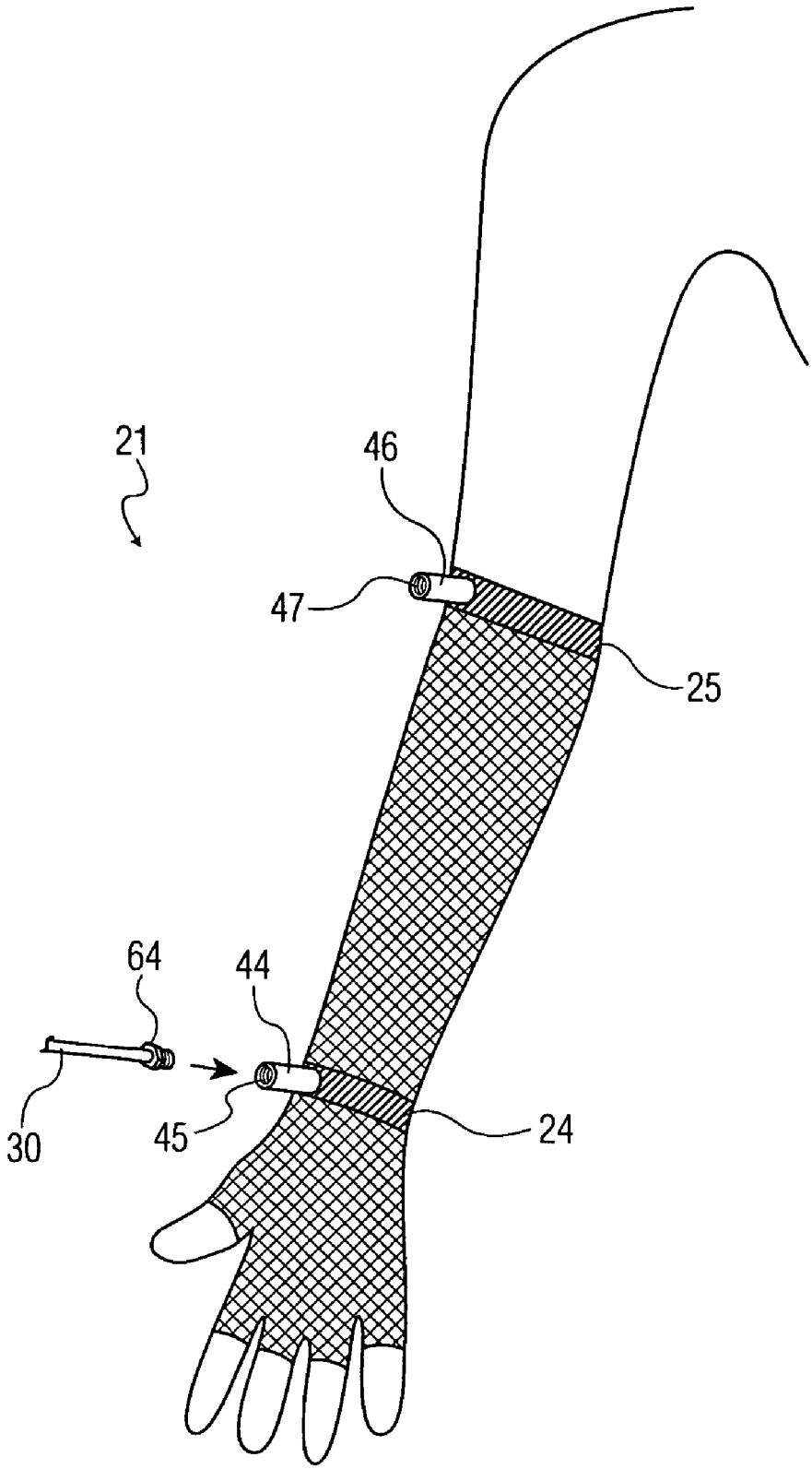
FIG. 3 is a perspective view of one of the gloves of the swimming simulator of FIG. 1.

Referring now to FIG. 3, the connection of resilient band 30 to wrist portion 24 of right glove 21 will be discussed in detail. A second male tension screw 64 identical to male tension screw 34 (FIG. 1A), is provided at the opposite end of resilient band 30 for connection to female receptor 44. Female receptor 44 protrudes from wrist portion 24 of right glove 21 and comprises threaded cavity 45 for receiving threaded male tension screw 64 of resilient band 30 in a manner similar to that described above with respect to the connection of tension screw 34 to hole 16 of bench 10. Female receptor 44 can be constructed of a metal.

Regarding connection of resilient member 31 to forearm portion 47, a male tension screw is provided at the end of resilient member 31 for threadily engaging threaded cavity 47 of female receptor 46, which protrudes from wrist portion 24 of right glove 21. Left glove 20 is connected to resilient members 30, 31 in an identical manner as discussed for right glove 21.

Gloves 20, 21 are fingerless and comprise wrist portion 24 and forearm portion 25. Wrist portion 24 and forearm portion 25 comprise hard rubber rings that are integral to the rest of the glove. Preferably, metal wire loops (not visible) extend through the centers of the hard rubber rings of wrist portion 24 and forearm portion 25. Female receptors 44 and

46 are connected to the metal wire loop of wrist portion 24 and forearm portion 25 respectively.

Socks 22, 23 and gloves 20,21 can be made out of a soft rubber, preferably a waterproof nylon, breathable membrane fabric. Other suitable materials are water proof lycra and nylon, stretchable polyester, acrylic coated marine polyester, and neoprene bonded polyester.

Referring back to FIG. 1, the length of resilient bands 30–33 and the angle at which resilient bands 30–33 connect to bench 10 are chosen so that when person 200 lies down on bench 10 and equips gloves 20,21 and socks 22, 23 and performs a swimming motion (i.e., a swimming stroke), the person's 200 movement of his/her left leg, right leg, left arm, and right arm is restricted by resilient band 30–33 during the entire range of motion. Resilient band 30 connects to bench 10 closer to forward end 17 than does resilient band 31. Resilient band 33 connects to bench 10 at a position closer to rear end 18 of bench 10 than does resilient band 32.

In using swimmer simulator 100 to exercise, person 200 lies on bench 10 in a substantially horizontal orientation. Person 200 can lie on their back or stomach. Person 200 equips gloves 20, 21 and socks 22–23. Person 200 then performs a swimming motion/stroke. Resilient band 30–33 are stretched, thereby restricting the person's 200 movement during the entire range motion.

While the invention has been described and illustrated in sufficient detail that those skilled in this art can readily make and use it, various alternatives, modifications, and improvements should become readily apparent without departing from the spirit and scope of the invention.

What is claimed is:

1. An exercise system for simulating a swimming motion comprising:

a bench for supporting a user;

a pair of gloves, each glove is connected to the bench by two resilient members, a first resilient member connects a wrist portion of each glove to the bench and a second resilient member connects a forearm portion of each glove to the bench;

a pair of socks, each sock is connected to the bench by two resilient members, a first resilient member connects an ankle portion of each sock to the bench and a second resilient member connects a shin portion of each sock to the bench;

connected to the bench at separate positions; and wherein when a user lies on the bench and engages the gloves and socks and performs a swimming motion, the user's movement is resisted by the resilient members during an entire range of motion.

2. The exercise apparatus of claim 1 wherein for each glove, the resilient member that connects to the wrist portion connects to the bench closer to a forward end of the bench than the resilient member that connects to the forearm portion.

3. The exercise apparatus of claim 1 wherein for each sock, the resilient member that connects to the ankle portion connects to the bench closer to a rear end of the bench than the resilient member that connects to the shin portion.

4. The exercise system of claim 1 wherein the wrist portion and the forearm portion comprise hard rubber rings to which the resilient members are attached.

5. The exercise system of claim 1 wherein the gloves are fingerless.

6. The exercise system of claim 2 wherein the bench comprises a planar portion atop a frame.

7. The exercise system of claim 6 wherein the resilient members connect to side portions of the planar portion.

8. The exercise system of claim 1 wherein the ankle portion and the shin portion comprise hard rubber rings to which the resilient members are attached.

9. The exercise system of claim 1 wherein the socks are toeless.

10. The exercise apparatus of claim 1 wherein the resilient members are connected to the bench by tension screws.

11. The apparatus of claim 1 further comprising a head rest attached to the bench.

* * * * *